US009805888B2

(12) United States Patent
Becerra et al.

(10) Patent No.: US 9,805,888 B2
(45) Date of Patent: Oct. 31, 2017

(54) HIGH SPEED LIMITING ELECTRICAL SWITCHGEAR DEVICE

(71) Applicant: ABB Schweiz AG, Baden (CH)

(72) Inventors: Marley Becerra, Västerås (SE); Stefan Valdemarsson, Lidköping (SE); Maurizio Curnis, Carvico (IT); Alessio Bergamini, Gazzaniga (IT); Henrik Breder, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/308,038

(22) PCT Filed: May 19, 2014

(86) PCT No.: PCT/EP2014/060176

§ 371 (c)(1),
(2) Date: Oct. 31, 2016

(87) PCT Pub. No.: WO2015/176734

PCT Pub. Date: Nov. 26, 2015

(65) Prior Publication Data

US 2017/0084410 A1 Mar. 23, 2017

(51) Int. Cl.
*H01H 53/00* (2006.01)
*H01H 33/28* (2006.01)
(Continued)

(52) U.S. Cl.
CPC ..... *H01H 33/285* (2013.01); *H01H 3/222* (2013.01); *H01H 71/42* (2013.01); *H01H 71/43* (2013.01)

(58) Field of Classification Search
CPC ..... H01H 33/285; H01H 3/222; H01H 71/43
(Continued)

(56) References Cited

U.S. PATENT DOCUMENTS 4,001,738 A * 1/1977 Terracol ..... H01H 73/045 335/147
4,292,611 A * 9/1981 Bresson ..... H01H 3/222 335/147

(Continued)

FOREIGN PATENT DOCUMENTS

DE 202011110140 U1 12/2012
EP 0147036 A1 7/1985

(Continued)

OTHER PUBLICATIONS

International Preliminary Report of Patentability Application No. PCT/EP2014/060176 dated May 18, 2016 7 Pages.

(Continued)

*Primary Examiner* — Shawki S Ismail
*Assistant Examiner* — Lisa Homza
(74) *Attorney, Agent, or Firm* — Whitmyer IP Group LLC

(57) ABSTRACT

An electrical switchgear for fast limitation and interruption of fault currents includes a fixed electrode, a movable electrode having a contact portion and a repelling portion, a plurality of contact fingers, and a coil. The coil is arranged adjacent to the repelling portion to induce eddy currents therein, the coil and the fixed electrode being arranged on the same side of the movable electrode, and the repelling portion being movable relative to the coil. The coil has a first dimension between two of its opposite lateral ends and defines an area which corresponds to a majority of a surface area of the repelling portion. The repelling portion provides a continuous current path, having a dimension corresponding to the first dimension, for eddy currents induced by the coil, whereby the movable electrode is pivotally thrown in a direction away from the coil and the fixed electrode, thus providing a circuit trip.

20 Claims, 3 Drawing Sheets

(51) Int. Cl.
*H01H 3/22* (2006.01)
*H01H 71/42* (2006.01)
*H01H 71/43* (2006.01)

(58) Field of Classification Search
USPC ..... 335/147
See application file for complete search history.

(56) References Cited

U.S. PATENT DOCUMENTS 4,467,301 A * 8/1984 Goodrich ..... H01H 1/54 335/195
4,631,508 A 12/1986 Cinquin et al.
5,030,804 A * 7/1991 Abri ..... H01H 1/2041 200/244
5,136,451 A * 8/1992 Valdemarsson ..... H01H 33/164 218/143
5,381,121 A * 1/1995 Peter ..... H01H 71/46 335/14
5,430,420 A * 7/1995 Maier ..... H01H 77/10 218/30
5,546,061 A * 8/1996 Okabayashi ..... H01H 9/443 335/126
5,952,744 A * 9/1999 Chitayat ..... H02K 41/03 310/12.31
6,013,889 A * 1/2000 Wieloch ..... H01H 77/10 218/22
6,066,998 A * 5/2000 Trumper ..... H01F 7/066 310/13
6,777,635 B2 8/2004 Baginski et al.
7,154,198 B2 * 12/2006 Kawai ..... H02K 41/03 310/12.15
7,671,711 B2 * 3/2010 Suzuki ..... H02K 41/03 200/330
7,777,600 B2 8/2010 Brooks
7,902,948 B2 * 3/2011 Luders ..... H01H 9/346 218/146
7,948,339 B2 * 5/2011 Burger ..... H01H 50/305 335/131
8,344,832 B2 * 1/2013 Lee ..... H01H 51/065 335/126
8,373,523 B2 * 2/2013 Valdemarsson ..... H01H 1/62 335/147
8,570,125 B2 * 10/2013 Suzuki ..... H01H 50/34 335/131
8,841,979 B2 * 9/2014 Uchida ..... H01H 1/54 335/131
8,981,883 B2 * 3/2015 Naka ..... H01H 1/54 335/133
2006/0061442 A1 * 3/2006 Brooks ..... H01F 7/1607 335/220
2011/0241809 A1 * 10/2011 Sugisawa ..... H01H 1/54 335/188
2013/0021122 A1 * 1/2013 Uchida ..... H01H 1/54 335/131
2013/0027158 A1 * 1/2013 Bach ..... H01H 3/222 335/158

FOREIGN PATENT DOCUMENTS

EP 0450104 A1 10/1991
EP 2194555 A1 6/2010
GB 553105 A 5/1943
WO 9745850 A1 12/1997
WO 0067271 A1 11/2000
WO 2014048483 A1 4/2014

OTHER PUBLICATIONS

International Search Report and Written Opinion of the International Searching Authority Application No. PCT/EP2014/060176 Completed: Jan. 14, 2015; dated Jan. 22, 2015 11 Pages.

* cited by examiner

HIGH SPEED LIMITING ELECTRICAL SWITCHGEAR DEVICE

TECHNICAL FIELD

The present disclosure generally relates to electrical switchgear for fast limitation and interruption of fault currents. In particular, it relates to a type of electrical switchgear which comprises a plurality of contact fingers arranged to divide current flowing through the electrical switchgear.

BACKGROUND

Electrical switchgear devices may be used for breaking a fault current in a circuit in the event of a fault, in order to limit damages which may be caused due to the fault current. An electrical switchgear device may comprise a plurality of movable contact fingers which are thrown away at a fast speed from a fixed contact or electrode upon a tripping operation. The movable contact fingers are parallel connected when in mechanical connection with the fixed contact, thereby dividing the current in a number of components equal to the number of movable contact fingers. Larger currents may thereby be handled by the electrical switchgear device.

In the event of a fast electric fault which creates a fault current of a large amplitude, it would generally be desirable to be able to trip the circuit as fast as possible. U.S. Pat. No. 6,777,635 discloses a very high-speed limiting electrical switchgear apparatus which comprises a circuit for handling fast electric faults with currents of large amplitude. The switchgear apparatus comprises a coil which is connectable to a voltage source in the event of a fault, wherein a Thomson effect thruster is thrown away from the coil towards the contact fingers. As a result, the contact fingers pivot clockwise, thus breaking the contact with fixed contacts, wherein a latch catches the contact fingers before they fall back into contact position.

Although the disclosure of U.S. Pat. No. 6,777,635 provides fast tripping, it would still be desirable to provide an even faster and more robust electrical switchgear device.

SUMMARY

In view of the above, an object of the present disclosure is thus to provide an electrical switchgear device which solves or at least mitigates the problems of the prior art.

There is hence provided an electrical switchgear device comprising: a fixed electrode arrangement, a movable electrode arrangement having a contact portion and a repelling portion, wherein the movable electrode arrangement is arranged to move between a closed position in which the contact portion contacts the fixed electrode arrangement, and an open position in which the contact portion is mechanically separated from the fixed electrode arrangement, wherein one of the fixed electrode arrangement or the contact portion comprises a plurality of contact fingers which are all parallel connected when the movable electrode arrangement is in the closed position, and a coil which is fixed relative to the repelling portion, wherein the repelling portion is arranged adjacent to the coil to enable the coil to induce eddy currents in the repelling portion, wherein the coil has a first dimension between two of its opposite lateral ends. The first dimension corresponds to a majority of the distance between the two outermost contact fingers, and the coil defines an area which corresponds to a majority of a surface area of the repelling portion. The repelling portion is adapted to provide a continuous current path, which has a dimension corresponding to the first dimension of the coil, for eddy currents induced by the coil in the repelling portion.

An effect which may be obtainable thereby is that a more robust electrical switchgear device may be provided. This is due to the fact that no additional actuator, such as the Thomson effect thruster in the prior art, is necessary for a breaking operation. The coil directly affects the movable electrode arrangement by induction of eddy current in the repelling portion, which thereby is thrown in a direction away from the coil due to the oppositely directed Lorentz forces. Since fewer mechanical components are utilised, fewer mechanical components will be subjected to the substantial wear due to the very high-power motion upon tripping. Furthermore, since there is a direct electromagnetic coupling between the coil and the movable electrode arrangement, tripping becomes faster than in the prior art where a coil induces a current in an actuator to throw the actuator towards the movable contacts in order to trip the circuit.

According to one embodiment, the coil is a flat coil defining a coil plane, wherein the repelling portion is arranged essentially in parallel with the coil plane when the movable electrode arrangement is in the closed position.

According to one embodiment, a width dimension of the repelling portion, which is a dimension between the two lateral ends of the repelling portion facing the flat coil, is at least as large as a corresponding width dimension of the fixed electrode portion.

According to one embodiment, the repelling portion defines a majority of the movable electrode arrangement, and the area defined by the flat coil corresponds to a majority of the movable electrode arrangement.

According to one embodiment, the fixed electrode arrangement are the contact fingers, and the movable electrode arrangement is a plate.

According to one embodiment, the movable electrode arrangement are the contact fingers, and the fixed electrode arrangement is a plate.

According to one embodiment, the continuous current path is provided by flexible conducting elements which are connected to the two outermost contact fingers to provide a current path for eddy currents induced by the flat coil.

According to one embodiment, the flexible conducting elements are in electrical contact with all of the contact fingers.

According to one embodiment, the flat coil is helical.

According to one embodiment, the entire flat coil is arranged adjacent the repelling portion such that eddy currents induced in the repelling portion by the flat coil mirror a current flowing in the flat coil along the entire flow path of the current.

According to one embodiment, the area defined by the flat coil is defined by the boundary of the flat coil.

According to one embodiment, the flat coil is connectable to a voltage source in response to a fault.

One embodiment comprises a structure which is fixed relative to the movable electrode arrangement, wherein the repelling portion is pivotally coupled to the structure to enable pivoting of the movable electrode arrangement between the closed position and the open position.

According to one embodiment, the electrical switchgear device is a low voltage electrical switchgear device or a medium voltage switchgear device.

According to one embodiment, the electrical switchgear device is an air circuit breaker.

Generally, all terms used in the claims are to be interpreted according to their ordinary meaning in the technical field, unless explicitly defined otherwise herein. All references to a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1A:
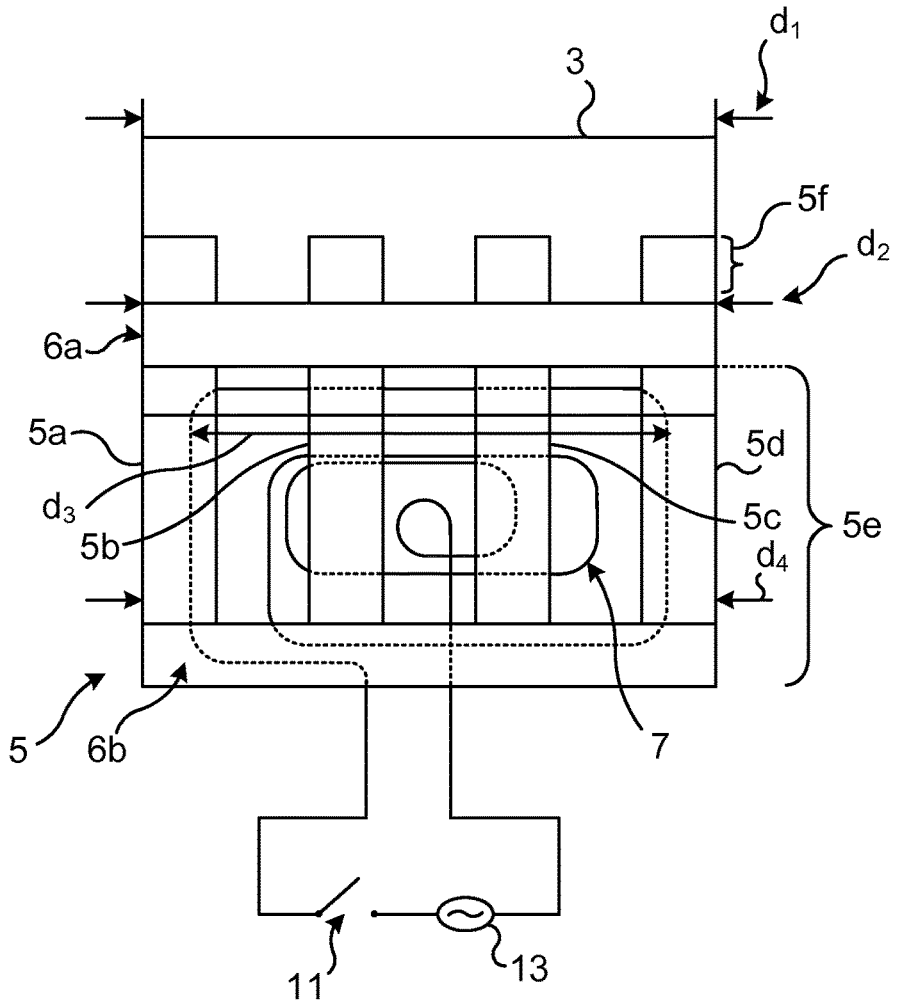
FIG. 1A schematically depicts a front view of a first example of an electrical switchgear device.

FIG. 1A depicts an electrical switchgear device 1 in a simplified manner. In particular, only the electrode contacts, which in a closed position are in mechanical contact with each other and in an open position are mechanically separated, are shown.

The electrical switchgear device 1 comprises a fixed electrode arrangement 3, a movable electrode arrangement 5, and a coil 7. In the following, the coil 7 will be exemplified by a flat coil although it is envisaged that a curved coil could be utilised instead, for example wound around an electromagnetic core.

The movable electrode arrangement 5 has a contact portion 5*f* and a repelling portion 5*e*, and is movable relative to the fixed electrode arrangement 3 and relative to the flat coil 7. The flat coil 7 and the fixed electrode arrangement 3 are arranged on the same side of the movable electrode arrangement 5 with the contact portion 5*f* facing the fixed electrode arrangement 3 and the repelling portion 5*e* facing the flat coil 7.

With a flat coil is meant a coil which is essentially a spiral coil, i.e. a helical coil, and/or a square-shaped coil, with the coil being wound in essentially a single plane, herein termed a coil plane. In FIG. 1A, the flat coil 7 is drawn with solid lines when visible and with dashed lines when hid behind the movable electrode arrangement 5.

According to the example depicted in FIG. 1A, the fixed electrode arrangement 3 is a plate, and the movable electrode arrangement 5 comprises a plurality of contact fingers 5*a*-5*d*. According to the example, four contact fingers are shown, but the number of contact fingers could of course vary and be fewer or more than what is exemplified in FIG. 1A. The contact fingers 5*a*-5*d* are longitudinal bars, which may comprise a plurality of laminated electrically conducting pieces, or may be made of a solid electrically conducting material. The repelling portion 5*e* of the movable electrode arrangement 5 is arranged to electromagnetically interact with the flat coil 7, and the contact portion 5*f* of the movable electrode arrangement 5 is arranged to be in contact with the fixed contact arrangement 3. It should be noted that with a portion is according to the present example meant to include several parts which are not coupled mechanically, i.e. a set of corresponding portions of all of the contact fingers. These together form both the repelling portion and the contact portion.

The repelling portion 5*e* has a continuous current path provided by means of flexible conducting elements 6*a* and 6*b* which are mechanically connected to the two outermost contact fingers 5*a* and 5*d*. The flexible conducting elements 6*a* and 6*b* hence traverse all of the contact fingers 5*a*-5*d*. The flexible conducting elements 6*a* and 6*b* provide an electrical connection between the two outermost contact fingers 5*a* and 5*d*. The flexible conducting elements 6*a* and 6*b* may also be connected to the remaining contact fingers 5*c* and 5*d* to enable actuation of also these contact fingers if the outermost contact fingers 5*a* and 5*d* are thrown away from the fixed electrode portion 5*f* due to opposite Lorentz forces. Alternatively, the outermost contact fingers may be coupled mechanically with the innermost contact fingers.

The repelling portion may optionally according to a variation of the movable electrode arrangement comprise additional flexible conducting elements, arranged between the flexible conducting elements 6*a* and 6*b* whereby additional contact points are provided between the two outermost contact fingers. The outermost contact fingers 5*a* and 5*d*, and the flexible conducting elements 6*a* and 6*b* define a rectangle, which according to one variation defines the boundary of an area of the repelling portion 5*e*. The area of the repelling portion 5*e* is larger than an area defined by the flat coil 7 and facing the repelling portion 5*e*, typically an area bounded by the outermost turn of the flat coil 7.

According to the example in FIG. 1A, the fixed electrode arrangement 3 has a width dimension d1 which is large enough to enable all of the contact fingers 5*a*-5*d* at the contact portion 5*f* to be arranged in mechanical contact with the fixed electrode arrangement 3 when the movable electrode arrangement 5 is in a closed position. The width dimension d2 of the contact portion 5*f*, from one outer contact finger 5*a* to the other outer contact finger 5*d* is hence typically as large as the width dimension d1 of the fixed electrode arrangement 3. In the closed position, the contact fingers 5*a*-5*d* are parallel connected. Moreover, in the closed position, current is able to flow between the fixed electrode arrangement 3 and the movable electrode arrangement 5.

Figure 1B:
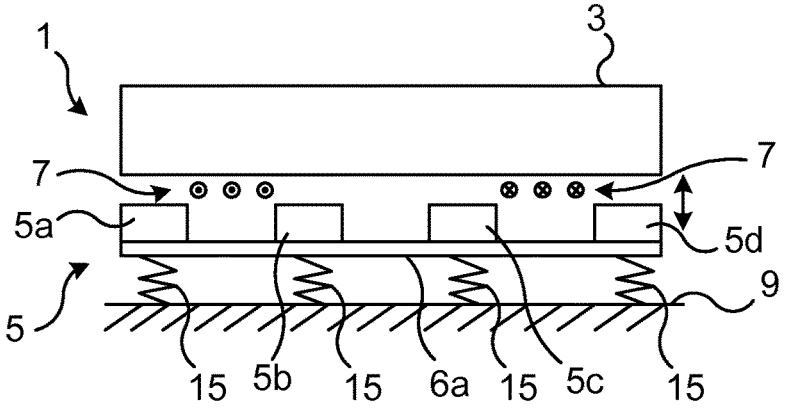
FIG. 1B depicts a top view of the electrical switchgear device in FIG. 1A.

The electrical switchgear device 1 further comprises a structure 9 which is fixed relative to the movable electrode arrangement 5, as shown in FIG. 1B. In particular, the movable electrode arrangement 5 may be pivotally coupled to the structure 9. The movable electrode arrangement 5 may hence pivot from the closed position to an open position in which the movable electrode arrangement 5 is mechanically separated from the fixed electrode arrangement 3 to thereby break a current flowing through a circuit in which the electrical switchgear device 1 may be connected. According to one variation, the structure 9 may actually be arranged to follow the opening movement of the movable electrode arrangement, especially if employing an additional mechanical mechanism which handles normal opening of the movable electrode arrangement, whereby the movable electrode arrangement is subjected to a translational and rotational motion upon a tripping operation which involves the coil 7.

The flat coil 7 has a first dimension d3, between two of its opposite lateral ends, which typically is smaller than the corresponding width dimension d2 of the contact portion 5*f*. The first dimension d3 corresponds to a majority of the distance between the two outermost contact fingers (width dimension d4 of the repelling portion). The flat coil 3 defines a coil plane, which is a plane within which at least one of the turns of the flat coil 3 is arranged; for a spiral coil, all of the turns may generally be arranged in the coil plane. The flat coil 7 is arranged adjacent to the repelling portion 5*e* when the movable electrode arrangement 5 is in the closed position. In this position, the surfaces of the repelling portion 5*e* which face the flat coil 7 are essentially parallel with the coil plane. Furthermore, the majority of the area defined by the repelling portion 5*e*, which is bounded by the two outermost contact fingers 5*a* and 5*d* and the two outermost flexible conducting elements 6*a* and 6*b*, overlaps with the area defined by the flat coil 7, e.g. the area defined by the outermost turn of the flat coil 7. In this manner, an eddy current path in the repelling portion 5*e*, which covers as large an area as possible may be provided. The larger the area in which eddy currents may circulate, the large the Lorentz force, and thus the faster the tripping action.

The flat coil 7 is connectable, for example by means of a switch 11, such as a power electronics switch, to a voltage source 13, for example a charged capacitor. It should be noted that the switch 11 and the voltage source 13 may, but need not necessarily form part of the electrical switchgear device 1; they may for example be external devices connectable to the electrical switchgear device. When a fault occurs, resulting in a fault current, the switch 11 is closed such that the voltage source 13 induces a current through the flat coil 7. Thus, when the switch 11 is closed and a current is induced in the flat coil 7, eddy currents are induced in the continuous current path defined by contact fingers 5*a*-5*d* and the flexible conducting elements 6*a*, 6*b*. These eddy currents flow in a direction opposite to the direction in which the current flows through the flat coil 7, creating opposite Lorentz forces. Since the flat coil 7 is arranged on the same side of the movable electrode arrangement 5 as the fixed electrode arrangement 3, the movable electrode arrangement is pivotally thrown in a direction away from the flat coil 7 and the fixed electrode arrangement 3, thus providing a circuit trip. FIG. 1B shows a top view of the electrical switchgear device 1 in an open state, in which the movable electrode arrangement 5 is arranged at a distance from the fixed electrode arrangement 3 and is thus in the open position. The movable electrode arrangement 5 is biased by means of energy accumulating members 15 such as springs, in order to ensure that all of the contact fingers 5*a*-5*d* are in mechanical contact with the fixed electrode arrangement 3 when in the closed position. The arrows show the directions in which the movable electrode arrangement 5 is able to move relative to the fixed electrode arrangement 3. The electrical switchgear device may comprise a latch arranged to catch the movable electrode arrangement in the open position such that it does not bounce back into mechanical contact with the fixed electrode arrangement.

Figure 2A:
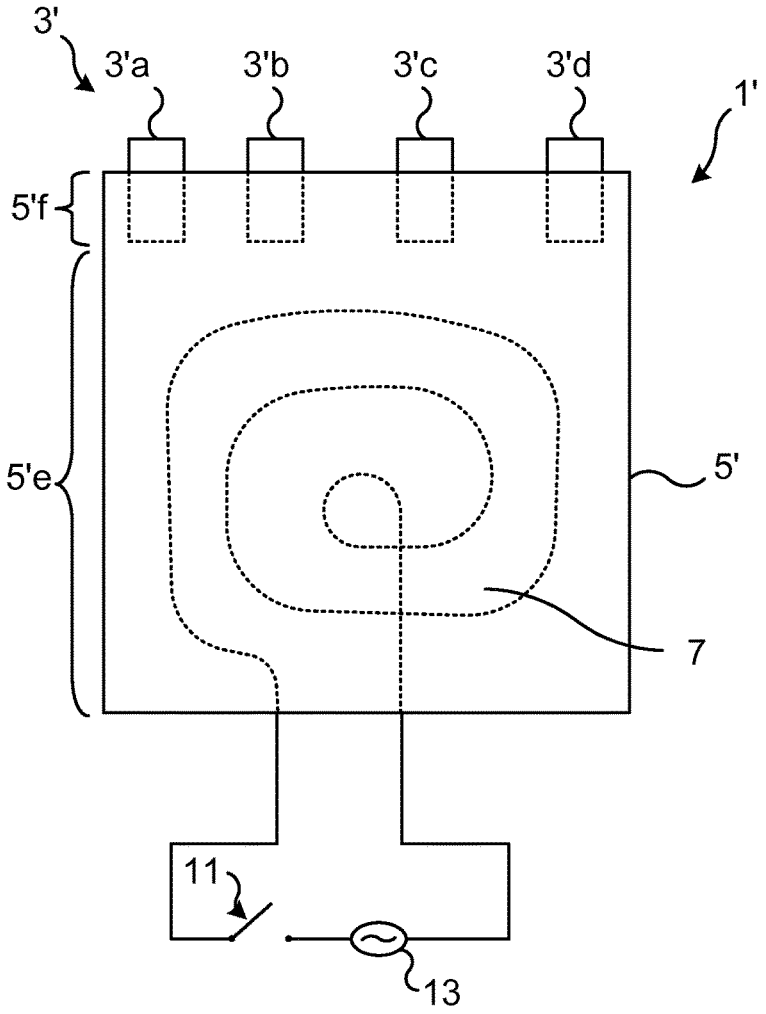
FIG. 2A schematically depicts a front view of a second example of an electrical switchgear device.
Figure 2B:
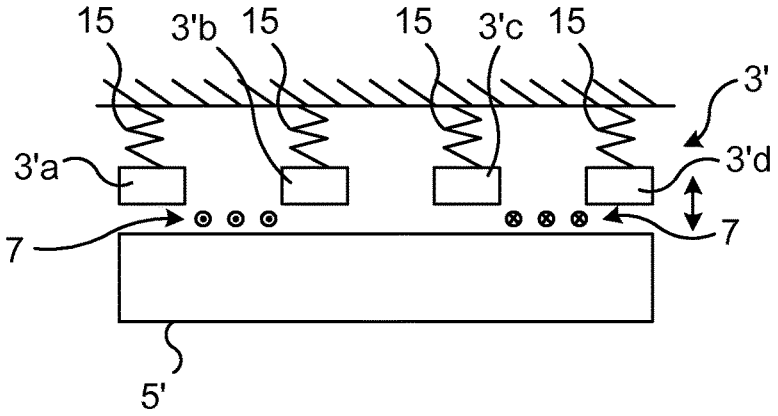
FIG. 2B depicts a top view of the electrical switchgear device in FIG. 2A.

With reference to FIGS. 2A and 2B, a second example of an electrical switchgear device will now be described. The electrical switchgear device 1' comprises a fixed electrode arrangement 3', a movable electrode arrangement 5', and a flat coil 7, arranged on the same side of the movable electrode arrangement 5' as the fixed electrode arrangement 3'.

According to the second example, the fixed electrode arrangement 3' comprises a plurality of contact fingers 3'*a*-3'*d*. The movable electrode arrangement 5' is a plate. The electrical switchgear device 1' functions in a similar manner as electrical switchgear device 1, except that the contact fingers now form part of the fixed electrode arrangement instead of the movable electrode arrangement. Furthermore, the fixed electrode arrangement 3' is now biased towards the movable electrode arrangement 5' by means of energy accumulating members 15. The dimensions of the flat coil 7 relative to the dimensions of the movable electrode arrangement 5', as described in the first example above, apply analogously also for the second example.

The movable electrode arrangement 5' has a contact portion 5"*f* arranged to mechanically contact the contact fingers 3'*a*-3'*d*, and a repelling portion 5'*e* which is arranged to electromagnetically interact with the flat coil 7. The repelling portion 5'*e* provides a continuous surface facing the flat coil 7, wherein the continuous surface has an area of which the majority overlaps with the area defined by the flat coil 7. Eddy currents may thereby be induced by the flat coil 7 in the repelling portion 5'*e* in a manner which enables the eddy currents to circulate around essentially the entire repelling portion 5'*e*, when the switch 11 is set in the closed position, enabling the voltage source to provide a current through the flat coil 7.

Figure 3:
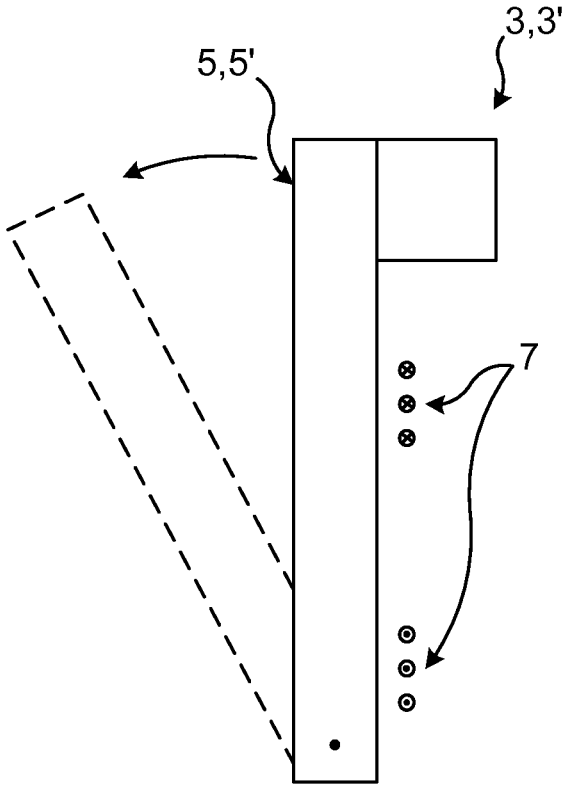
FIG. 3 schematically shows the operation of the electrical switchgear devices shown in FIGS. 1A and 2A.

FIG. 3 depicts a side view of any of the electrical switchgear devices 1, 1' with the movable electrode arrangement 5, 5' in the closed position shown with solid lines, and with the movable electrode arrangement [[4]]5, 5' in the open position shown with dashed lines.

In both examples, the flat coil 7 may be helical, i.e. a spiral coil, for example with a circular or essentially circular-shape, or square or essentially square-shape.

In either embodiment, the electrical switchgear device may comprise an additional mechanical mechanism for normal opening of the contacts, i.e. to set the movable electrode arrangement in the open position, while the coil 7 is used only in case of fault or interruptions with very high currents. An example of a mechanism of this type is described in U.S. Pat. No. 6,777,635.

The electrical switchgear devices presented herein may beneficially be utilised in low voltage applications or medium voltage applications, wherein the electrical switchgear devices may be a low voltage electrical switchgear devices or a medium voltage switchgear devices, respectively. The electrical switchgear devices disclosed herein may be utilised in both AC and DC applications. The electrical switchgear devices may by circuit breakers, such as air circuit breakers.

The inventive concept has mainly been described above with reference to a few examples. However, as is readily appreciated by a person skilled in the art, other embodiments than the ones disclosed above are equally possible within the scope of the inventive concept, as defined by the appended claims. For example, according to one variation both the fixed electrode arrangement and the movable electrode arrangement could comprise contact fingers.

The invention claimed is:

1. An electrical switchgear device comprising:

a fixed electrode arrangement, a movable electrode arrangement having a contact portion and a repelling portion, the movable electrode arrangement being arranged to move between a closed position in which the contact portion contacts the fixed electrode arrangement, and an open position in which the contact portion is mechanically separated from the fixed electrode arrangement, one of the fixed electrode arrangement or the contact portion having a plurality of contact fingers which are all parallel connected when the movable electrode arrangement is in the closed position, and a coil, wherein the repelling portion is arranged adjacent to the coil to enable the coil to induce eddy currents in the repelling portion, wherein the coil and the fixed electrode arrangement are arranged on the same side of the movable electrode arrangement, and wherein the repelling portion is movable relative to the coil, and wherein the coil has a first dimension between two opposite lateral ends of the coil, the first dimension corresponding to a majority of a distance between the two outermost contact fingers, wherein the coil defines an area which corresponds to a majority of a surface area of the repelling portion, and wherein the repelling portion is adapted to provide a continuous current path, having a dimension corresponding to the first dimension of the coil, for eddy currents induced by the coil in the repelling portion, whereby the movable electrode arrangement is pivotally thrown in a direction away from the coil and the fixed electrode arrangement, thus providing a circuit trip.

2. The electrical switchgear device according to claim 1, wherein the coil is a flat coil defining a coil plane, wherein the repelling portion is arranged in parallel with the coil plane when the movable electrode arrangement is in the closed position.

3. The electrical switchgear device as claimed in claim 2, wherein a width dimension of the repelling portion, which is a dimension between two lateral ends of the repelling portion facing the flat coil, is at least as large as a corresponding width dimension of the fixed electrode portion.

4. The electrical switchgear device as claimed in claim 3, wherein the repelling portion defines a majority of the movable electrode arrangement, and wherein the area defined by the flat coil corresponds to the majority of the movable electrode arrangement.

5. The electrical switchgear device as claimed in claim 3, wherein the flat coil is helical.

6. The electrical switchgear device as claimed in claim 2, wherein the repelling portion defines a majority of the movable electrode arrangement, and wherein the area defined by the flat coil corresponds to the majority of the movable electrode arrangement.

7. The electrical switchgear device as claimed in claim 2, wherein the flat coil is helical.

8. The electrical switchgear device as claimed in claim 2, wherein the flat coil is circular-shaped or square-shaped.

9. The electrical switchgear device as claimed in claim 2, wherein the entire flat coil is arranged adjacent to the repelling portion such that eddy currents induced in the repelling portion by the flat coil mirror a current flowing in the flat coil along an entire flow path of the current.

10. The electrical switchgear device as claimed in claim 2, wherein the area defined by the flat coil is defined by a boundary of the flat coil.

11. The electrical switchgear device as claimed in claim 2, wherein the fixed electrode arrangement comprises the contact fingers, wherein the movable electrode arrangement comprises a plate.

12. The electrical switchgear device as claimed in claim 2, wherein the movable electrode arrangement comprises the contact fingers, wherein the fixed electrode arrangement comprises a plate.

13. The electrical switchgear device as claimed in claim 1, wherein the fixed electrode arrangement comprises the contact fingers, wherein the movable electrode arrangement comprises a plate.

14. The electrical switchgear device as claimed in claim 1, wherein the movable electrode arrangement comprises the contact fingers, wherein the fixed electrode arrangement comprises a plate.

15. The electrical switchgear device as claimed in claim 14, wherein the continuous current path is provided by flexible conducting elements which are connected to the two outermost contact fingers to provide a current path for eddy currents induced by the coil.

16. The electrical switchgear device as claimed in claim 15, wherein the flexible conducting elements are in electrical contact with all of the contact fingers.

17. The electrical switchgear device as claimed in claim 1, wherein the coil is connectable to a voltage source in response to a fault.

18. The electrical switchgear device as claimed in claim 1, comprising a structure which is fixed relative to the movable electrode arrangement, wherein the repelling portion is pivotally coupled to the structure to enable pivoting of the movable electrode arrangement between the closed position and the open position.

19. The electrical switchgear device as claimed in claim 1, wherein the electrical switchgear device is a low voltage electrical switchgear device or a medium voltage switchgear device.

20. The electrical switchgear device as claimed in claim 1, wherein the electrical switchgear device is an air circuit breaker.

* * * * *